US005997789A

United States Patent [19]

Okumura et al.

[11] Patent Number: 5,997,789

[45] Date of Patent: Dec. 7, 1999

[54] PROCESS OF MELT-SPINNING SYNTHETIC FIBER

[75] Inventors: Yoshiharu Okumura, Okazaki; Hiroshi Takahashi, Mishima; Yuhei Maeda; Katsunori Matsuda, both of Okazaki, all of Japan

[73] Assignee: Toray Industries, Inc., Japan

[21] Appl. No.: 09/047,613

[22] Filed: Mar. 25, 1998

[30] Foreign Application Priority Data

Mar. 31, 1997 [JP] Japan ..... 9-078688
Mar. 31, 1997 [JP] Japan ..... 9-078689

[51] Int. Cl.[6] ..... D01D 1/10; D01D 4/02; D01D 5/08; D01F 1/10

[52] U.S. Cl. ..... 264/169; 264/176.1; 264/211

[58] Field of Search ..... 264/169, 176.1, 264/211

[56] References Cited

U.S. PATENT DOCUMENTS 4,512,731 4/1985 Cobb .
4,946,592 8/1990 Galaj et al. .

FOREIGN PATENT DOCUMENTS 6-101119 4/1994 Japan .
702 936 1/1954 United Kingdom .

*Primary Examiner*—Leo B. Tentoni
*Attorney, Agent, or Firm*—Austin R. Miller

[57] ABSTRACT

A method for melt-spinning synthetic fiber, characterized by using a spinning device of which the part to be contacted with polymer in melt is coated with a film of an oxide, nitride or carbide of any of Si, Ti, Zr, Al, W, B, Ta and Ge or with a film of heat-resistant resin.

12 Claims, No Drawings

PROCESS OF MELT-SPINNING SYNTHETIC FIBER

BACKGROUND OF THE INVENTION

The present invention relates to an improved melt-spinning method and apparatus for synthetic fiber in which polymer melt being melt-spun is prevented from being thermally deteriorated and from forming impurities, and to an improved filter to be used for melt spinning of synthetic fiber. In particular, it relates to an improvement in the inner surface of a melt-spinning device.

Synthetic fiber of, for example, polyamide or polyester is melt-spun, and the melt-spun synthetic fiber is widely used in various fields of clothes and industrial materials as having good mechanical and chemical properties.

Apparatus for spinning polymer melt is generally composed of a device for melting polymer, a device for metering the resulting polymer melt, and a spinning pack for jetting out the thus-metered polymer melt, in which those devices are connected to each other via a pipe line. In the apparatus of that type, the polymer melt as fed into the spinning pack via the pipe line is distributed therein, then filtered and spun out through a spinneret. The spinning pack is composed of various members of a distributor, a filter, a pressure plate, a spinneret, etc. As the members constituting the melt-spinning device, generally used are those made of inexpensive stainless steel materials having well-balanced and good strength, corrosion resistance and workability. As the filter, generally used is a granular filter of, for example, silica sand, glass beads, alumina grains or stainless steel grains, either singly or as combined with a wire-netting filter. Recently, however, a plate filter made of non-woven fabric of fine metal fiber is being preferably used alone in place of the granular filter. The metal fiber constituting the plate filter is generally made of a stainless steel material. In ordinary melt-spinning apparatus for synthetic fiber that are popularly used at present, almost all the wall surfaces of the spinning device and other most members, with which the polymer melt being spun therethrough is contacted, are made of metal, and, naturally, the metal is in fact stainless steel except for limited exceptions such as sealant.

Stainless steel used for the pack members and filter is a well-balanced good material having various advantages noted above, and is difficult to substitute with any other materials. However, as so reported in Japanese Patent Publication (JP-B) No. Sho-53-29732, substances kept in contact with stainless steel members are often catalytically decomposed and deteriorated. JP-B Sho-53-29732 discloses the details of the catalytic action of the stainless steel members of a melt-spinning apparatus on the polymer melt of polyester or polyamide 66 being melt-spun therethrough, which is to decompose and deteriorate the polymer melt. The gel as formed through the decomposition and deterioration of the polymer melt causes various troubles such as yarn breaking or fuzz in the spinning and drawing step.

For polyamide fiber to be used in industrial materials, copper salts and/or various antioxidants are added to the polymer melt to be spun, which are for the purpose of improving the heat resistance of the fiber.

Though being effective in improving the heat resistance of polyamide fiber, copper salts added to polyamide melt are problematic in that they form copper compounds and metal copper that are insoluble in polyamide melt due to the high-temperature heat history applied to the melt being spun. The thus-formed copper compounds and metal copper precipitate and deposit on the surface of the wall of the flow duct in the spinning device thereby clogging the duct, or precipitate and deposit on the filter thereby increasing the pressure loss in filtration therethrough and shortening the exchange cycle of the spinning pack, or they penetrate into the spun fiber thereby causing various troubles such as yarn breaking or fuzz in the spinning and drawing step, and even lowering the process stability in the post-processing steps for, for example, warping, twisting and dipping the spun fiber after the spinning and drawing step. As so reported in Japanese Patent Application Laid-Open (JP-A) No. Hei-1-207417, it is known that, when polyamide melt containing a copper salt as the stabilizer is kept in contact with a metal member made essentially of iron, for example, with a stainless steel member in a spinning device, the formation of insoluble copper compounds is accelerated due to the electrochemical reaction between the copper ions and the iron component in the member. For this reason, it is unfavorable to use a stainless steel material in forming the wall of the melt-spinning device to be contacted with the polymer melt being spun therethrough.

The troubles to be caused by the contact between the polymer melt and the stainless steel or the like metal member in the spinning device may occur throughout the entire region of the polymer melt pathway, but they occur noticeably around the filter, especially the plate filter made of stainless steel fiber having a large contact area with polymer melt, as so reported in JP-B Sho-53-29732, and also JP-A Hei-7-268715 and Hei-7-268716.

In order to evade the troubles in melt spinning noted above, proposed is a means of using a high-chromium alloy in the filter part having a large contact area with polymer melt, in JP-B Sho-53-29732. Also in JP-A Hei-1-207417, it is written that a high-chromium alloy is effective in preventing the precipitation of copper compounds from polyamide that contains copper as the antioxidant while the polyamide melt is spun. However, the high-chromium alloy is expensive and is poorly workable, and it is extremely difficult to form the alloy into a plate filter of non-woven fabric of the alloy fiber to be favorably used in melt spinning of polymer melt. Even if chromium may be plated on the surface of members to thereby increase the chromium density in their surface, the plating is not applicable to members having a complicated shape.

Apart from surface modification with chromium, JP-A Hei-6-101119 discloses the use of $SiO_2$, $Al_2O_3$, TiC or the like as the material of the surface of members to be contacted with pitch melt to be melt-spun. However, pitch is a low-molecular polymer naturally containing many impurities in large quantities, while as compared with this, polymers having a high degree of polymerization, such as polyester and nylon, have a lower impurity content and are more stable. JP-A Hei-6-101119 suggests nothing about the effect of the surface material used therein in melt spinning of such high-molecular polymers.

JP-B Hei-5-32485, Hei-5-32486 and Hei-5-32487 disclose a method of melt-spinning synthetic fiber through a granular filter made of alumina grains, stainless steel grains or the like, or through a combination of the granular filter and a plate filter, in which is both the granular filter and the plate filter optionally combined with it are coated with a modified silicone film. However, these are silent on any other film-forming substances except modified silicone, and has no disclosure relating to the technique of melt-spinning nylon that contains a copper compound as the antioxidant and even the technique of preventing the precipitation of the antioxidant from nylon being spun. In these patent publications, only the deterioration of polymer on the surface of the granular filter is discussed, but nothing is suggested therein relating to the essential effect of the present invention which is directed to preventing the formation of impurities on the surface of a filter, especially a metal fiber filter, to thereby prevent the pressure loss in filtration through the filter from being increased and to improving the capability of the filter.

The troubles to be caused by the contact between metal members such as typically stainless steel members and polymer melt noted above are frequently seen especially in melt spinning of polymer melt, but are not limited to only the case of melt spinning operation. The troubles in question are common to all shaping techniques for forming articles from resin melt, for example, for forming films from resin melt, for molding shaped articles from resin melt and even for forming pellets from resin melt.

As has been mentioned hereinabove, stainless steel materials have the advantage of high strength, good workability and low cost, but have the disadvantage of promoting the deterioration of polymer as contacted therewith. Therefore, it is desired not to use any special and expensive materials, except for stainless steel materials, to construct devices for shaping polymer melt. In particular, it is desired to carry out melt-spinning of polymer melt, while using inexpensive melt-spinning devices not having any negative influences on the polymer melt being spun therethrough.

SUMMARY OF THE INVENTION

The present invention provides an improved melt-spinning method for producing synthetic fiber, an improved shaping device for resin melt, and an improved filter to be used in the method and apparatus.

The method for melt-spinning synthetic fiber of the invention comprises using a spinning device of which the part to be contacted with polymer in melt is coated with a film of an oxide, nitride or carbide of any of Si, Ti, Zr, Al, W, B, Ta and Ge or with a film of heat-resistant resin. Preferably, the film is of at least one compound selected from the group consisting of $SiO_2$, $TiO_2$, $ZrO_2$, $Al_2O_3$, SiC, TiN, TiCN and TiC or of a polyorganosiloxane compound or a polyimide compound.

The film is formed at least on the inner wall of the spinning pack and/or on the filter in the spinning device. Preferably, the filter is a plate filter made essentially of metal fiber and having a degree of air permeability of from 0.5 to 10 liters/$cm^2$/min under a differential pressure of 30 $mmH_2O$.

The plate filter of metal fiber is preferably a laminate composed of sintered non-woven fabric of metal fiber and a wire-netting filter. More preferably, the laminate comprises a plurality of layers of sintered non-woven fabric of metal fiber which differ from each other in the fiber diameter and/or the porosity.

In the laminate comprising such a plurality of layers of sintered non-woven fabric of metal fiber, the fibers constituting the layer of sintered non-woven fabric of metal fiber having the smallest fiber diameter preferably have a mean diameter of from 5 to 30 $\mu$m.

Also preferably, the plate filter has a thickness of from 0.2 to 4 mm and a unit weight of from 400 to 9000 g/$m^2$, and is used in the form of a flat plate, a leaf disc, a cylinder, or a pleated cylinder.

The polymer to which the invention is applied is preferably thermoplastic polyamide and/or thermoplastic polyester. Especially preferably, the invention is applied to thermoplastic polyamide containing a copper compound as the stabilizer.

The invention encompasses the shaping device for resin melt and also the filter noted above, which are favorably used in the melt-spinning method. To coat the intended area of the shaping device for resin melt and the filter with the film noted above, preferably used is a dipping or wet-coating method.

DETAILED DESCRIPTION OF THE PREFERRED EMBODIMENTS

The synthetic resin-forming polymer for use in the invention is not specifically defined. The invention is applied to melt-spinning of various synthetic resin-forming polymers, which include, for example, aliphatic polyamide-type polymers such as nylon 6, nylon 66, nylon 46, nylon 4, nylon 11, nylon 12, nylon 610, nylon 612, etc.; aromatic polyamide-type polymers such as xylylenediamine-based polyamides, etc.; polyester-type polymers such as polyethylene terephthalate, polybutylene terephthalate, polypropylene terephthalate, polyethylene naphthalate, liquid-crystalline polyesters; and also other thermoplastic synthetic polymers and copolymers such as typically polyphenylenesulfide-based, polyolefin-based and polyalkylene-based polymers and copolymers; and their blends. In particular, the invention is favorably applied to melt-spinning of polymers that are easily decomposed at high temperatures, such as polyamides and polyesters.

The synthetic fiber-forming polymer for use in the invention may contain various additives and pigments to improve the heat resistance, the weather resistance and the flame retardancy of the polymer and to control the color of the polymer. The invention is especially effective in preventing the formation of insoluble impurities from copper compounds added to polyamides. The copper compounds include, for example, inorganic copper salts such as copper iodide, copper bromide, copper chloride, etc.; organic copper salts such as copper acetate, copper stearate, copper isophthalate, etc.; copper complexes of inorganic or organic copper salts with organic compounds such as 2-mercaptobenzimidazole, etc.; and their mixtures. They may be either cuprous salts or cupric salts. The polyamide fiber containing any of those copper salts may additionally contain a stabilizer. The stabilizer includes, for example, alkali metal halides such as potassium iodide, potassium bromide, etc.; alkaline earth metal halides such as magnesium iodide, zinc iodide, etc.; halogen-substituted, aromatic hydrocarbons such as tetraiodobenzene, pentaiodobenzene, tetrabromobenzene, tetraiodo-terephthalic acid, etc.; and quaternary ammonium halides such as tetraethylammonium iodide, etc. It further includes complex salts of copper salts with halides.

The film to be formed in the part of a spinning device that is directly contacted with polymer melt must be made from a substance that is electrochemically stable and thermally stable in a temperature range of from 250 to 320° C. in which synthetic fiber-forming polymer is generally melt-spun. In the invention, the film is made from an oxide or nitride or carbide of any of Si, Ti, Zr, Al, W, B, Ta and Ge or from a heat-resistant resin. As preferred examples of the oxide, nitride and carbide, mentioned are $SiO_2$, $TiO_2$, $ZrO_2$, $Al_2O_3$, SiC, TiN, TiCN and TiC. As preferred examples of the heat-resistant resin, mentioned are polyorganosiloxanes and polyimides. One or more of these may be used either singly or as combined to form the film. The film may have a uniform structure, or may be composed of a plurality of layers each having a different composition in the direction of the thickness thereof.

As the polyorganosiloxanes, preferred are those capable of easily forming cured films under heat at from 100 to 300°

C. or so or with modifying catalysts. Concretely mentioned are methylhydrogen-polysiloxanes, alcohol-modified polysiloxanes, epoxy-modified polysiloxanes, amino-modified polysiloxanes, etc.

The polyimide film may be formed by applying a solution of a polyamic acid onto the substrate and drying it. The diamine component constituting the polyamic acid includes, for example, p-phenylenediamine, 4,4'-diaminodiphenyl ether, etc.; and the acid dianhydride component constituting it includes, for example, pyromellitic dianhydride, 3,3',4,4'-biphenyltetracarboxylic dianhydride, 3,3',4,4'-benzophenone-tetracarboxylic dianhydride, etc.

To form the film in the intended area of a spinning device to be contacted with polymer, employable is a dipping or wet-coating method in which the part of the spinning device is dipped in a liquid containing the film-forming substance, or a liquid containing the film-forming substance is applied onto the part of the spinning device, and is dried thereon. Apart from this, also employable is any of vacuum vapor deposition or CVD. Preferred is the dipping or wet-coating method, as it is widely applicable to various parts of spinning devices and various filters irrespective of their shape, and as its operation is simple and inexpensive.

The film-forming substance is preferably any of $SiO_2$, $TiO_2$, $ZrO_2$, $Al_2O_3$ or polyorganosiloxanes, from the viewpoint that it is suitable to dipping or wet coating. As the film-forming substance, of which the solution can form the intended film, for example, usable is a hydroxylated polysiloxane or a modified hydroxylated polysiloxane in which a part of the hydroxyl groups are modified with an alkyl group or the like, to form a film of $SiO_2$. The film-forming substances to form films of $TiO_2$, $ZrO_2$ or $Al_2O_3$ include, for example, metal alcoholates with Ti, Zr or Al, such as tetrabutyl titanate, tetraisobutyl titanate, zirconium butoxide, zirconium n-propoxide, etc., and their oligomers; and metal chelates such as titanium tetraacetylactonate, titanium ethyl acetacetate, titanium octylene glycolate, titanium lactate, titanium triethanol aminate, zirconium acetylacetonate, zirconium butoxyacetylacetonate, zirconyl acetate, aluminium acetylacetonate, etc., and their oligomers. In the dipping or wet-coating method, usable is a solution of any of those substances. Various polyorganosiloxanes mentioned above may also be formed into their solutions with ease that are usable in the dipping or wet-coating method. Of those film-forming substances noted above, especially preferred are $SiO_2$ and polyorganosiloxanes as easily forming uniform films.

Film-forming inorganic substances and polyorganosiloxanes capable of forming films in the dipping or wet-coating method are, after having been applied onto substrates and heated thereon or reacted with modifying catalysts thereon, crosslinked and cured. Where the film is cured under heat, the parts coated with the film may be assembled into a spinning device after the coating film is heated and cured, or, alternatively, after the coating film is dried only without being cured, the coated parts are assembled into a spinning device and then crosslinked and cured while the device is pre-heated prior to the start of spinning fiber through the device.

Where $SiO_2$ or polyorganosiloxanes are used as the film-forming substance to form the intended films through dipping or wet-coating, if desired, methyltrimethoxysilane, dimethyldimethoxysilane or the like may be added thereto to thereby control the crosslinking density of the films to be formed. Regarding their characteristics, in general, the coating films having a higher crosslinking density shall have higher heat resistance and higher mechanical strength, whilst those having a lower crosslinking density shall be more flexible and have higher adhesiveness to substrates.

The film-forming treatment may be effected every time when a spinning device having used is disassembled into parts and cleaned. However, where the coating film still remains stable on the disassembled and cleaned parts of the spinning device used, it may be directly and repeatedly re-used as such. Naturally, in this case, the film-forming treatment may not be effected every time in disassembling and cleaning the device.

Parts of a spinning device and filters as coated with the film may be handled in the same manner as in handling conventional ones. Therefore, these can be assembled into a spinning device and pre-heated in any ordinary manner prior to use in melt spinning.

One and the same film-forming substance may be used in coating therewith different parts of a spinning device, but different film-forming substances may be used to form films having a different thickness, depending on the parts to be processed therewith and on the shape of filters also to be processed therewith.

The thickness of the coating film is not specifically defined, but is preferably from 0.005 to 20 $\mu$m, more preferably from 0.01 to 10 $\mu$m. Thinner films having a thickness of smaller than 0.005 $\mu$m are unfavorable, as they are difficult to form and could not sufficiently and entirely separate the metal substrate of stainless steel or the like from the polymer melt. On the other hand, thicker films having a thickness of larger than 20 $\mu$m are also unfavorable, as they will often be cracked or peeled off due to the difference in the thermal expansion coefficient between the metal substrate and the films.

The spinning device as referred to herein indicates a series of a device system in which a polymer as fed thereinto in the form of chips is melted, metered, filtered and spun out in the form of yarn strands of polymer melt. Concretely, it is equipped with a screw-type or pressure melter-type melting device, a metering pump, a spinning pack, a filter and pipe lines to connect them. In the spinning pack, the polymer melt as fed thereinto through a pipe line is distributed, optionally filtered, and then uniformly jetted out through a spinneret. This is composed of various members of a distributor, a spinneret, a pressure plate, and a housing. The filter may be composed of a member of filtering grains, such as sand, glass beads or the like, as combined with a plate filter member made of, for example, wire netting or rough, non-woven fabric of metal. Preferably, however, a plate filter having a member of non-woven fabric of thin metal fibers as the filtering layer is used singly. In the spinning device of this system, polymer melt may be filtered anywhere in the spinning pack as constructed by disposing a filter above the pressure plate and/or above the spinneret thereby to make it have therein the filter member along with the other spinning pack members, or in the pathway zone after the melting device and before the spinning pack, or even in both the spinning pack and the pathway zone.

The part to be coated with the film according to the invention includes any and every surface area to be contacted with polymer melt passing through the spinning device. For example, for a screw-type melt-extrusion spinning device, all the screw, the barrel, the metering pump, the pipe line, the spinning pack members and the filter constituting the device shall be coated with the film.

It is desirable that all the parts noted above are coated with the film. However, even if only the wall surface of the spinning pack members which have complicated pathways and through which polymer melt passes at a low speed is coated with the film, or even if only the filter member which has a large surface area and which therefore induces the increase in the filtration pressure loss if insoluble polymer residues deposit thereon is coated with the film, such may be greatly effective in improving the spinnability and the drawability of the fiber being spun and even in improving the quality of the fiber to be finally obtained. Where both the wall surface of the spinning pack members and the filter member are coated with the film, much better results are obtained.

In particular, the effect of the coating film of the invention for preventing the increase in the filtration pressure loss is especially noticeable when the film is applied to a plate filter which has a high degree of filtering accuracy and which therefore often causes the increase in pressure loss in filtration therethrough. Referring to the degree of air permeability as one parameter of the filtering accuracy of a plate filter, the coating film of the invention is effectively applied to plate filters having a degree of air permeability to fall between 0.5 and 10 liters/$cm^2$/min, more preferably between 0.7 and 7 liters/$cm^2$/min, even more preferably between 1 and 5 liters/$cm^2$/min, under a differential pressure of 30 $mmH_2O$. Plate filters having a degree of air permeability of larger than 10 liters/$cm^2$/min naturally have large fiber-to-fiber spaces, and, therefore, few deposits are formed around the metal fibers constituting them, and those filters cause little increase in the filtration pressure loss. Accordingly, even if the coating film of the invention is applied to such rough plate filters, its effect will be small. On the other hand, the filtration pressure loss through plate filters having a degree of air permeability of smaller than 0.5 liters/$cm^2$/min is large even in the initial stage of filtration therethrough, resulting in that the amount of polymer capable of passing therethrough is small. Therefore, such tight plate filters are unfavorable.

The filtering accuracy of the plate filter to which the coating film of the invention is effectively applied preferably falls between 3 $\mu$m and 50 $\mu$m, more preferably between 5 $\mu$m and 30 $\mu$m, when measured according to JIS B8356, from the viewpoint of preventing the decrease in the processable amount of polymer passing through the filter and of ensuring the intended filtering capability of the filter.

The plate filter of metal fiber to which the invention is applied Is preferably made of sintered, non-woven fabric of metal fiber in order to have an increased degree of filtering accuracy and a prolonged life. The sintered, non-woven fabric of metal fiber may be a single-layered one, but is preferably in the form of a laminate as formed by laminating a plurality of sintered, non-woven metal fabric layers each having a different fiber size and/or a different porosity. On its one surface or both surfaces, the sintered, non-woven fabric of metal fiber may optionally be laminated with a wire-netting filter, which is for pre-filtration or for protecting and reinforcing the fabric.

In order to significantly display its effect, the coating film of the invention is preferably applied to a plate filter having a high degree of filtering accuracy, as so mentioned hereinabove, and for this, the plate filter is preferably of non-woven fabric of metal fiber. Regarding the size of metal fibers constituting the fabric, it is preferable that the mean diameter of the fibers constituting a plate filter of a single-layered, non-woven metal fabric, or the mean diameter of fibers constituting the layer having the smallest fiber diameter of a laminate filter composed of a plurality of non-woven metal fabric layers each having a different fiber size falls between 5 and 30 $\mu$m, more preferably between 8 and 25 $\mu$m, in order to prevent the processable amount of polymer passing through the filter from being reduced and to effectively attain the intended filtration effect of the invention.

Plate filters of metal fiber having a degree of filtering accuracy of larger than 50 $\mu$m, and laminate plate filters of metal fiber of which the layer of non-woven metal fabric having the smallest fiber diameter has a mean fiber diameter of larger than 30 $\mu$m naturally cause little increase in the filtration pressure loss as few deposits are formed around the metal fibers constituting them. Therefore, even if the coating film of the invention is applied to those filters, its effect will be small. As opposed to those, the filtration pressure loss through plate filters having a degree of filtering accuracy of smaller than 3 $\mu$m, or through laminate plate filters of which the layer having the smallest fiber diameter has a mean fiber diameter of smaller than 5 $\mu$m is naturally large even in the initial stage of filtration therethrough, resulting in that the amount of polymer capable of passing therethrough is small. Therefore, those filters are unfavorable.

Regarding the porosity of the non-woven metal fabric to be used in the plate filter to which the coating film of the invention is effectively applied, it is desirable that the porosity in question falls between 60 and 90%, more preferably between 70 and 85%, in order that the fabric is prevented from being clogged to cause the increase in the filtration pressure loss through it and is prevented from having a lowered compression strength to be deformed due to the filtration pressure applied thereto.

Non-woven metal fabric having a porosity of smaller than 60% is easily clogged to cause the increase in the filtration pressure loss through it; while that having a porosity of larger than 90% is easily deformed under compression during use, as its compression strength is low. Therefore, non-woven metal fabric of which the porosity oversteps the defined range is unfavorable.

The thickness and the unit weight of the plate filter may be suitably determined, depending on the object of the invention. However, in order to ensure both the high filtering accuracy and the long life of the plate filter while preventing the increase in the cost for producing it with no benefit to the increase in the filtering capability of the plate filter produced at such an increased production cost, it is preferable that the thickness of the plate filter falls between 0.2 and 4 mm, more preferably between 0.4 and 3 mm, and that the unit weight thereof falls between 400 and 9000 g/$m^2$, more preferably between 500 and 6000 g/$m^2$.

According to the method of the invention and using the spinning device thereof, it is possible to prevent the formation of insoluble impurities and gels owing to the contact of polymer melt with metal parts in the device, and to prevent the polymer melt passing through the device from being deteriorated, resulting in that the increase in the filtration pressure loss through the filter in the device is prevented and even the trouble of yarn breaking during spinning operation is prevented. As a result, the exchange cycle of the spinning pack used in the device may be prolonged, and high-quality fiber products can be produced stably and inexpensively.

The melt-spinning method of the invention is applicable to the production of multi-filaments, mono-filaments, stable, spun-bond, non-woven fabric and the like of synthetic fiber noted above.

As has been mentioned hereinabove, the device and the filter of which the surface is coated with a coating film according to the invention are not limited to those for melt-spinning of synthetic fiber, but are also effectively used in apparatus for shaping resin or polymer melt in which resin or polymer melt such as that used in melt-spinning of synthetic fibers is formed into films, shaped articles, or even into pellets.

EXAMPLES

Now, the invention is described concretely with reference to the following Examples. Methods for determining the characteristics of substances as referred to herein are mentioned below.

(1) Relative viscosity in sulfuric acid (of polyamide):

2.5 g of a sample is dissolved in 25 cc of 98% sulfuric acid, and the viscosity of the resulting solution is measured at 25° C. using an Ostwald viscometer.

(2) Intrinsic viscosity (of polyester):

8 g of a sample is dissolved in 100 ml of orthochlorophenol, and the viscosity ($\eta$) of the resulting solution is measured at 25° C. using an Ostwald viscometer. The intrinsic viscosity (IV) of the sample is calculated according to the following equation:

$$IV=0.0242\eta+0.2634$$

(3) Filtration pressure loss:

The pressure at the upstream side of the spinning pack and that at the secondary side of the metering pump are measured, using a diaphragm gauge.

(4) Yarn breaking:

A shock sensor of Keyence's GA245 Model is disposed in the thread line for the final roller (the 5th roller), while being spaced by 1 cm away from the surface of the roller. A fiber, if cut while running around the roller, beats the sensor. The number of beatings is counted.

Example 1

Phenolic silicone resin (SH840, manufactured by Toray-Dow Corning Silicone Co.) was diluted with toluene to have a solid concentration of 0.3%. In the resulting resin solution, dipped was a plate filter composed essentially of tabular, non-woven, stainless steel fabric and having a diameter of 150 mm, for 30 seconds, then dried in air, and cured in an oven at 180° C. for 30 minutes. Thus, the plate filter was coated with the silicon resin. The constitution of the plate filter, and the properties thereof before and after the coating treatment are shown in Table 1.

Using the plate filter prepared herein, polyethylene terephthalate containing no color-toning inorganic grains and having IV=1.20 was melt-spun. The amount of the polymer passing through the filter was 720 kg/day.

The filtration pressure loss through the filter as measured just after the start of the spinning, and 7 days and 14 days after the start of the spinning is shown in Table 2.

In this where the resin-coated plate filter was used, the increase in the filtration pressure loss through the filter was small, and stable spinning was continued for a long period of time.

Comparative Example 1

Using the same device and under the same condition as in Example 1, except that the plate filter was not coated with resin, polyethylene terephthalate was melt-spun.

The filtration pressure loss through the filter as measured just after the start of the spinning, and 7 days after the start of the spinning is shown in Table 2.

In this where the non-coated plate filter was used, the increase in the filtration pressure loss through the filter was great, and continuous spinning for 7 days or longer was impossible.

Example 2

Methylhydrogen-silicone (SH1107, manufactured by Toray-Dow Corning Silicone Co.) was diluted with isopropyl alcohol to have a solid concentration of 0.5%. In the resulting resin solution, dipped was a plate filter composed essentially of tabular, non-woven, stainless steel fabric and having a diameter of 150 mm, for 30 seconds, then dried in air, and cured in an oven at 180° C. for 30 minutes. Thus, the plate filter was coated with the silicon resin. The constitution of the plate filter, and the properties thereof before and after the coating treatment are shown in Table 1.

Using the plate filter prepared herein, nylon 66 containing 0.03% of copper iodide and 0.03% of potassium iodide as the antioxidant but no color-toning inorganic grains and having a relative viscosity in sulfuric acid of 3.6 was melt-spun. The amount of the polymer passing through the filter was 500 kg/day.

The filtration pressure loss through the filter as measured just after the start of the spinning, and 7 days and 14 days after the start of the spinning is shown in Table 2.

In this where the resin-coated plate filter was used, the increase in the filtration pressure loss through the filter was small, and stable spinning was continued for a long period of time.

Example 3

Hydroxylated polysiloxane (Ceramate C513, manufactured by Shokubai Kasei KK) was diluted with isopropyl alcohol to have a solid concentration of 0.15%. In the resulting solution, dipped was a plate filter composed essentially of non-woven, stainless steel fabric and having a diameter of 150 mm, which is the same as in Example 2, for 30 seconds, then dried in air, and cured in an oven at 180° C. for 30 minutes. Thus, the plate filter was coated with silica ($SiO_2$). The constitution of the plate filter, and the properties thereof before and after the coating treatment are shown in Table 1.

Using the plate filter prepared herein, the same polymer, nylon 66 as in Example 2 was melt-spun. The spinning flow rate herein was the same as in Example 2.

The filtration pressure loss through the filter as measured just after the start of the spinning, and 7 days and 14 days after the start of the spinning is shown in Table 2.

In this where the $SiO_2$-coated plate filter was used, the increase in the filtration pressure loss through the filter was small, and stable spinning was continued for a long period of time, as in Example 2.

Comparative Example 2

Using the same device and under the same condition as in Example 2, except that the plate filter was not coated with resin, nylon 66 was melt-spun.

The filtration pressure loss through the filter as measured just after the start of the spinning, and 7 days after the start of the spinning is shown in Table 2.

In this where the non-coated plate filter was used, the increase in the filtration pressure loss through the filter was great, and continuous spinning for 7 days or longer was impossible.

Example 4

The same $SiO_2$ film-forming solution as in Example 3 (Ceramate C513, manufactured by Shokubai Kasei KK) was diluted with isopropyl alcohol (IPA) to have a solid concentration of 1.5 wt. %. All spinning pack members (made of stainless steel) except the filter made of non-woven, stainless steel fabric, which are to be contacted with polymer melt, were coated with the resulting solution, and dried at room temperature. On the other hand, the same plate filter of non-woven stainless steel fabric as in Example 2 was dipped in the same $SiO_2$ film-forming solution as above but diluted with IPA to have a solid concentration of 0.5 wt. %, and then dried at room temperature. Thus were prepared herein $SiO_2$-coated pack members and filter.

These spinning pack members and filter were assembled into a spinning pack, then heated at 300° C. for 24 hours in a preheating oven, and fitted to a spinning apparatus. Using the thus-constructed spinning apparatus, nylon 6 having a relative viscosity in sulfuric acid of 3.8 was melt-spun under the condition shown in Table 3.

The initial filtration pressure loss, the filtration pressure loss after 7 days, and the frequency of yarn breaking during spinning operation are shown in Table 4.

In this where the $SiO_2$-coated pack members and filter were used, the increase in the filtration pressure loss through the filter was small during continuous spinning operation, and stable spinning with little yarn breaking was possible.

Example 5

The same spinning process as in Example 4 was repeated, except that a non-coated filter of non-woven stainless steel fabric was used.

The initial filtration pressure loss, the filtration pressure loss after 7 days, and the frequency of yarn breaking during spinning operation are shown in Table 4.

In this where the $SiO_2$-coated pack members were used, the increase in the filtration pressure loss through the filter was small during continuous spinning operation, and stable spinning with little yarn breaking was possible.

Comparative Example 3

Herein used were the same pack members and filter of non-woven stainless steel fabric as in Example 4, but the members and the filter were not subjected to the surface-coating treatment. These non-coated spinning pack members and filter were assembled into a spinning pack, then heated at 300° C. for 24 hours in a preheating oven, and fitted to a spinning apparatus. Using the thus-constructed spinning apparatus, nylon 6 having a relative viscosity in sulfuric acid of 3.8, which is the same as in Example 4, was melt-spun under the same condition as in Example 4 shown in Table 3.

The initial filtration pressure loss, the filtration pressure loss after 7 days, and the frequency of yarn breaking during spinning operation are shown in Table 4.

In this where the non-coated pack members and filter were used, the increase in the filtration pressure loss through the filter became larger with the lapse of spinning time, being different from that in the case where the same but coated pack members and filter were used. In addition, the frequency of yarn breaking during spinning operation in the former was larger than that in the latter.

Example 6

A $TiO_2$ film-forming solution (Atolon NTi-500, manufactured by Nippon Soda Co.) was diluted with isopropyl alcohol (IPA) to have a solid concentration of 3 wt. %. All spinning pack members (made of stainless steel) except the filter, which are to be contacted with polymer melt, were coated with the resulting solution, and dried at room temperature. On the other hand, a plate filter of non-woven stainless steel fabric, which is shown in Table 1, was dipped in the same $TiO_2$ film-forming solution as above but diluted with IPA to have a solid concentration of 1 wt. %, and then dried at room temperature. Thus were prepared herein $TiO_2$-coated pack members and filter.

These spinning pack members and filter were assembled into a spinning pack, then heated at 300° C. for 24 hours in a preheating oven, and fitted to a spinning apparatus. Using the thus-constructed spinning apparatus, polyethylene terephthalate having an intrinsic viscosity of 1.2 was melt-spun under the condition shown in Table 3.

The initial filtration pressure loss, the filtration pressure loss after 7 days, and the frequency of yarn breaking during spinning operation are shown in Table 4.

In this where the $TiO_2$-coated pack members and filter were used, the increase in the filtration pressure loss through the filter was small during continuous spinning operation, and stable spinning with little yarn breaking was possible.

Comparative Example 4

Herein used were the same pack members and filter of non-woven stainless steel fabric as in Example 6, but the members and the filter were not subjected to the surface-coating treatment. These non-coated spinning pack members and filter were assembled into a spinning pack, then heated at 300° C. for 24 hours in a preheating oven, and fitted to a spinning apparatus. Using the thus-constructed spinning apparatus, polyethylene terephthalate having an intrinsic viscosity of 1.2, which is the same as in Example 6, was melt-spun under the condition shown in Table 3.

The initial filtration pressure loss, the filtration pressure loss after 7 days, and the frequency of yarn breaking during spinning operation are shown in Table 4.

In this where the non-coated pack members and filter were used, the increase in the filtration pressure loss through the filter became larger with the lapse of spinning time, being different from that in the case where the same but coated pack members and filter were used. In addition, the frequency of yarn breaking during spinning operation in the former was larger than that in the latter.

Example 7

An $SiO_2$ film-forming solution (Ceramate C513, manufactured by Shokubai Kasei KK) was diluted with isopropyl alcohol (IPA) to have a solid concentration of 1.5 wt. %. All spinning pack members except the filter made of non-woven, stainless steel fabric, which are to be contacted with polymer melt, were coated with the resulting solution, and dried at room temperature. On the other hand, methylhydrogen-polysiloxane (SH1107, manufactured by Toray Dow Corning Silicone Co.) was diluted to have a solid concentration of 0.2%. In the resulting solution, dipped was a filter of non-woven stainless steel fabric shown in Table 1, then dried at room temperature, and cured at 180° C. for 30 minutes.

The thus-coated spinning pack members and filter were assembled into a spinning pack, then heated at 300° C. for 24 hours in a preheating oven, and fitted to a spinning apparatus. Using the thus-constructed spinning apparatus, nylon 6 containing 0.02% of copper acetate, 0.1% of potassium iodide and 0.1% of potassium bromide as the stabilizer, and having a relative viscosity in sulfuric acid of 3.8 was melt-spun under the condition shown in Table 3.

The initial filtration pressure loss, the filtration pressure loss after 7 days, and the frequency of yarn breaking during spinning operation, which was counted by the shock sensor disposed above the final roller just before the winding-up device, are shown in Table 4.

In this where the pack members coated with $SiO_2$ and the filter coated with methylhydrogen-polysiloxane were used, the increase in the filtration pressure loss through the filter was small during continuous spinning operation, and stable spinning with little yarn breaking was possible.

The initial filtration pressure loss, the filtration pressure loss after 7 days, and the frequency of yarn breaking during spinning operation, which was counted by the shock sensor disposed above the final roller just before the winding-up device, are shown in Table 4.

In this where the non-coated pack members and filter were used, the increase in the filtration pressure loss through the filter became larger with the lapse of spinning time, being different from that in the case where the same but coated pack members and filter were used. In addition, the frequency of yarn breaking during spinning operation in the former was larger than that in the latter.

TABLE 1

| | | Example 1, Comparative Example 1 | Examples 2 to 5, Comparative Examples 2, 3 | Examples 6, 7, Comparative Examples 4, 5 |
|---|---|---|---|---|
| Constitution of Filter | Upstream Side | #200 wire netting<br>30 μm non-woven fabric<br>9 μm non-woven fabric<br>#50 wire netting | #200 wire netting<br>40 μm non-woven fabric<br>15 μm non-woven fabric<br>#50 wire netting | #200 wire netting<br>40 μm non-woven fabric<br>17 μm non-woven fabric<br>#50 wire netting |
| | Downstream Side | #20 wire netting | #20 wire netting | #20 wire netting |
| Before Coating Treatment | Air Permeability (liter/cm$^2$/min) | 2.1 | 2.8 | 3.2 |
| | Overall Thickness (mm) | 1.9 | 2.4 | 2.2 |
| | Overall Weight (g/m$^2$) | 3408 | 4211 | 3908 |
| | Thickness of Non-woven Metal Fabric (mm) | 0.55 | 1.10 | 0.90 |
| | Weight of Non-woven Metal Fabric (g/m$^2$) | 1012 | 1820 | 1530 |
| After Coating Treatment | Air Permeability (liter/cm$^2$/min) | 2.1 | 2.7 | 3.1 |
| | Overall Thickness (mm) | 1.9 | 2.4 | 2.2 |
| | Overall Weight (g/m$^2$) | 3417 | 4224 | 3917 |
| | Thickness of Non-woven Metal Fabric (mm) | 0.55 | 1.10 | 0.90 |
| | Thickness of Non-woven Metal Fabric (mm) | 1019 | 1831 | 1538 |

Comparative Example 5

Herein used were the same pack members and filter of non-woven stainless steel fabric as in Example 7, but the members and the filter were not subjected to the surface-coating treatment. These non-coated spinning pack members and filter were assembled into a spinning pack, then heated at 300° C. for 24 hours in a preheating oven, and fitted to a spinning apparatus. Using the thus-constructed spinning apparatus, nylon 6 containing 0.02% of copper acetate, 0.1% of potassium iodide and 0.1% of potassium bromide, as the stabilizer, and having a relative viscosity in sulfuric acid of 3.8, which is the same as in Example 7, was melt-spun under the condition shown in Table 3.

TABLE 2

| | Example | | | Comparative Example | |
|---|---|---|---|---|---|
| | 1 | 2 | 3 | 1 | 2 |
| Initial Filtration Pressure Loss ($10^5$ Pa) | 210 | 170 | 170 | 210 | 170 |
| Filtration Pressure Loss after 7 days ($10^5$ Pa) | 230 | 185 | 185 | 270 | 225 |
| Filtration Pressure Loss after 14 days ($10^5$ Pa) | 260 | 215 | 220 | Unusable | Unusable |

TABLE 3

| | Examples 4, 5, Comparative Example 3 | Example 6, Comparative Example 4 | Example 7, Comparative Example 5 |
|---|---|---|---|
| Number of Filaments (–) | 144 | 196 | 204 |
| Fineness of Drawn Yarn (deniers) | 840 | 1000 | 1260 |
| Spinning Pack Temperature (°C.) | 285 | 300 | 280 |
| Heating Hood Length (cm) | 30 | 30 | 30 |
| Heating Hood Temperature (°C.) | 300 | 300 | 300 |
| First Roller Temperature) (°C.) | not heated | 70 | not heated |
| First Roller Speed (m/min) | 500 | 600 | 500 |
| Second Roller Temperature (°C.) | 50 | 95 | 50 |
| Second Roller Speed (m/min) | 515 | 620 | 515 |
| Third Roller Temperature (°C.) | 170 | 110 | 170 |
| Third Roller Speed (m/min) | 1850 | 2200 | 1850 |
| Fourth Roller Temperature (°C.) | 200 | 220 | 200 |
| Fourth Roller Speed (m/min) | 2553 | 3300 | 2553 |
| Fifth Roller Temperature (°C.) | 130 | not heated | 130 |
| Fifth Roller Speed (m/min) | 2501 | 3200 | 2501 |

TABLE 4

| | Example 4 | Example 5 | Example 6 | Example 7 |
|---|---|---|---|---|
| Initial Filtration Pressure Loss ($10^5$ Pa) | 170 | 170 | 160 | 150 |
| Filtration Pressure Loss after 7 days ($10^5$ Pa) | 180 | 195 | 172 | 155 |
| Frequency of Yarn breaking (times/t) | 0.5 | 0.8 | 0.4 | 1.0 |
| | Comparative Example 3 | Comparative Example 4 | Comparative Example 5 | |
| Initial Filtration Pressure Loss ($10^5$ Pa) | 170 | 160 | 150 | |
| Filtration Pressure Loss after 7 days ($10^5$ Pa) | 220 | 215 | 190 | |
| Frequency of Yarn breaking (times/t) | 1.8 | 0.9 | 2.8 | |

What is claimed is:

1. A method for melt-spinning synthetic fiber comprising forming synthetic fiber from at least one melted high molecular weight polymer by melt-spinning with a spinning device of which a part to be contacted with said melted polymer is coated with a film of an oxide, nitride or carbide of an element selected from the group consisting of Si, Ti, Zr, Al, W, B, Ta and Ge or with a film of a heat-resistant resin.

2. The method for melt-spinning synthetic fiber as claimed in claim 1, wherein the film is of at least one compound selected from the group consisting of $SiO_2$, $TiO_2$, $ZrO_2$, $Al_2O_3$, SiC, TiN, TiCN and TiC.

3. A method for melt-spinning synthetic fiber comprising forming synthetic fiber with a spinning device of which a part to be contacted with melted polymer is coated with a film of an oxide, nitride or carbide of an element selected from the group consisting of Si, Ti, Zr, Al, W, B, Ta and Ge or with a film of heat-resistant resin, wherein the heat-resistant resin film is a polyorganosiloxane compound or a polyimide compound.

4. The method for melt-spinning synthetic fiber as claimed in claim 1, wherein the film is formed at least on the inner wall of the spinning pack and/or on the filter in the spinning device.

5. A method for melt-spinning synthetic fiber comprising forming synthetic fiber with a spinning device of which a part to be contacted with melted polymer is coated with a film of an oxide, nitride or carbide of an element selected from the group consisting of Si, Ti, Zr, Al, W, B, Ta and Ge or with a film of a heat-resistant resin, wherein the film is formed at least on the inner wall of the spinning pack and/or on the filter in the spinning device and wherein the filter is a plate filter made essentially of metal fiber and having a degree of air permeability of from 0.5 to 10 liters/$cm^2$/min under a differential pressure of 30 $mmH_2O$.

6. The method for melt-spinning synthetic fiber as claimed in claim 5, wherein the plate filter of metal fiber is a laminate composed of sintered non-woven fabric of metal fiber and a wire-netting filter.

7. The method for melt-spinning synthetic fiber as claimed in claim 6, wherein the laminate comprises a plurality of layers of sintered non-woven fabric of metal fiber which differ from each other in the fiber diameter and/or the porosity.

8. The method for melt-spinning synthetic fiber as claimed in claim 6 or 7, wherein, in the laminate comprising a plurality of layers of sintered non-woven fabric of metal fiber, the fibers constituting the layer of sintered non-woven fabric made of metal fiber having the smallest fiber diameter have a mean diameter of from 5 to 30 $\mu$m.

9. The method for melt-spinning synthetic fiber as claimed in claim 5, wherein the plate filter has a thickness of from 0.2 to 4 mm and a unit weight of from 400 to 9000 g/$m^2$.

10. The method for melt-spinning synthetic fiber as claimed in claim 5, wherein the plate filter is used in the form of a flat plate, a leaf disc, a cylinder, or a pleated cylinder.

11. A method for melt-spinning synthetic fiber comprising forming synthetic fiber with a spinning device of which a part to be contacted with melted polymer is coated with a film of an oxide, nitride or carbide of an element selected from the group consisting of Si, Ti, Zr Al, W, B, Ta and Ge or with a film of heat-resistant resin, wherein the polymer is thermoplastic polyamide and/or thermoplastic polyester.

12. A method for melt-spinning synthetic fiber comprising forming synthetic fiber with a spinning device of which a part to be contacted with melted polymer is coated with a film of an oxide, nitride or carbide of an element selected from the group consisting of Si, Ti, Zr, Al, W, B, Ta and Ge or with a film of heat-resistant resin, wherein the polymer is thermoplastic polyamide containing a copper compound as the stabilizer.

* * * * *